US008718515B2

(12) United States Patent
Kamimura

(10) Patent No.: US 8,718,515 B2
(45) Date of Patent: May 6, 2014

(54) IMAGE FORMING APPARATUS AND CARTRIDGE

(75) Inventor: Naoya Kamimura, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 200 days.

(21) Appl. No.: 13/294,361

(22) Filed: Nov. 11, 2011

(65) Prior Publication Data

US 2012/0121289 A1 May 17, 2012

(30) Foreign Application Priority Data

Nov. 12, 2010 (JP) ..... 2010-254089

(51) Int. Cl.
*G03G 15/00* (2006.01)

(52) U.S. Cl.
USPC ..... 399/167

(58) Field of Classification Search
USPC ..... 399/111, 167
See application file for complete search history.

(56) References Cited

U.S. PATENT DOCUMENTS

| | | | |
|---|---|---|---|
| 7,702,275 | B2 | 4/2010 | Morishita |
| 2008/0175617 | A1 | 7/2008 | Morishita |
| 2010/0080635 | A1 | 4/2010 | Kamimura |

FOREIGN PATENT DOCUMENTS

| | | | |
|---|---|---|---|
| JP | 63-086673 | U | 6/1988 |
| JP | 2-100083 | A | 4/1990 |
| JP | 4-282648 | A | 10/1992 |
| JP | 7-210032 | A | 8/1995 |
| JP | 8-054047 | A | 2/1996 |
| JP | 9-311516 | A | 12/1997 |
| JP | 9-325620 | A | 12/1997 |
| JP | 2000-112309 | A | 4/2000 |
| JP | 2000-327165 | A | 11/2000 |
| JP | 2003-036007 | A | 2/2003 |
| JP | 2003-177619 | A | 6/2003 |
| JP | 2008-096978 | A | 4/2008 |
| JP | 2008-233748 | A | 10/2008 |
| JP | 2009-145633 | A | 7/2009 |
| JP | 2010-079204 | | 4/2010 |

OTHER PUBLICATIONS

JP OA dd Jan. 29, 2013, JP Appln. 2010-254089, English translation.

*Primary Examiner* — Walter L Lindsay, Jr.
*Assistant Examiner* — Barnabas Fekete
(74) *Attorney, Agent, or Firm* — Banner & Witcoff, Ltd.

(57) ABSTRACT

An image forming apparatus is provided that may include a photosensitive drum configured to rotate around an axis and a first rotational member disposed proximate a periphery of the photosensitive drum and configured to rotate about an axis parallel to the rotational axis of the photosensitive drum. The image forming apparatus may also include a driving-force transmitting member and a driven member, which includes a transmitted portion and a first engaging projection. The driven member may rotate about the rotational axis of the photosensitive drum together with the photosensitive drum and the transmitted portion of the driven member may receive a driving force transmitted from the driving-force transmitting member. The image forming apparatus may also include a rotational-member driving gear which has a loose fit portion configured to engage with the first engaging projection and a transmission gear portion configured to transmit the driving force to the first rotational member.

15 Claims, 15 Drawing Sheets

IMAGE FORMING APPARATUS AND CARTRIDGE

CROSS REFERENCE TO RELATED APPLICATION

This application claims priority from Japanese Patent Application No. 2010-254089 filed Nov. 12, 2010, the entire subject matter of which is incorporated herein by reference.

FIELD OF DISCLOSURE

The present disclosure relates to image forming apparatuses, such as laser printers.

BACKGROUND

An example of an image forming apparatus, such as a laser printer, has a cleaning roller for removing deposited matter, such as residual toner and paper dust, on the circumferential surface of a photosensitive drum. The cleaning roller is disposed such that the circumferential surface thereof is in contact with the circumferential surface of the photosensitive drum. The cleaning roller is rotated such that the contact portion with respect to the circumferential surface of the photosensitive drum is moved in the same direction as the moving direction of the circumferential surface of the photosensitive drum.

A driving force for rotating the cleaning roller is transmitted from the photosensitive drum. That is, a drum gear rotated together with the photosensitive drum is provided at an end of the photosensitive drum. Further, a cleaning gear rotated together with the cleaning roller is provided at an end of the cleaning roller. The cleaning gear meshes with the drum gear. When a driving force is input to the photosensitive drum, the photosensitive drum is rotated, and the driving force is transmitted from the drum gear to the cleaning gear. Thus, the cleaning roller is rotated.

However, because the drum gear meshes with the cleaning gear, the rotation speed of the drum gear and, therefore, the photosensitive drum may vary due to the meshing conditions or the like, which may result in banding (a banded pattern developed on an image due to uneven density).

SUMMARY

Aspects of the present disclosure are to provide an image forming apparatus in which the rotational speed of a photosensitive drum can be stabilized.

For example, aspects of the present disclosure relate to an image forming apparatus which may include a photosensitive drum configured to rotate around an axis and a first rotational member disposed proximate a periphery of the photosensitive drum and configured to rotate about an axis parallel to the rotational axis of the photosensitive drum. The image forming apparatus may also include a driving-force transmitting member and a driven member, which includes a transmitted portion and a first engaging projection. The driven member may be configured to rotate about the rotational axis of the photosensitive drum together with the photosensitive drum and the transmitted portion of the driven member may be configured to receive a driving force transmitted from the driving-force transmitting member. The image forming apparatus may also include a rotational-member driving gear which has a loose fit portion configured to engage with the first engaging projection and a transmission gear portion configured to transmit the driving force to the first rotational member. The rotational-member driving gear may be rotatable about the rotational axis of the driven member.

Further aspects of the disclosure relate to an image forming apparatus which includes a photosensitive drum configured to rotate around an axis and a first rotational member disposed proximate a periphery of the photosensitive drum and configured to rotate about an axis parallel to the rotational axis of the photosensitive drum. The image forming apparatus may also include a driving-force transmitting member and a driven member, which includes a transmitted portion and a flange fitted to an end of the photosensitive drum. The driven member may be configured to rotate about the rotational axis of the photosensitive drum together with the photosensitive drum and the transmitted portion of the driven member may be configured to receive a driving force transmitted from the driving-force transmitting member. The driven member may also include a joint which includes first engaging projections formed apart from each other with respect to the rotational axis of the joint. The image forming apparatus may also include a rotational-member driving gear which includes a loose fit portion configured to engage with the first engaging projections and a transmission gear portion configured to transmit the driving force to the first rotational member. The rotational-member driving gear may be rotatable about the rotational axis of the driven member or a rotational axis parallel to the rotational axis of the driven member. The joint may be disposed between the flange and the rotational-member driving gear. The flange may include second engaging projections formed apart from each other with respect to the rotational axis of the driven member. The joint may include two notches extending in the radial direction of the joint and configured to engage with the second engaging projections. The loose fit portion may include two loose fit portions corresponding to the first engaging projections, the loose fit portions having clearances with respect to the first engaging projections both in the rotation direction and the radial direction of the rotational-member driving gear. The driven member, the rotational-member driving gear, and the joint may form an Oldham's coupling.

Additional aspects of the disclosure relate to a cartridge which may include a photosensitive drum configured to rotate around an axis and a first rotational member disposed proximate a periphery of the photosensitive drum and configured to rotate about an axis parallel to the rotational axis of the photosensitive drum. The cartridge may also include a driven member which includes a transmitted portion and a first engaging projection. The driven member may be configured to rotate about the rotational axis of the photosensitive drum together with the photosensitive drum and the transmitted portion of the driven member may be configured to receive a driving force transmitted from outside. The cartridge may also include a rotational-member driving gear, which includes a loose fit portion configured to engage with the first engaging projection and a transmission gear portion configured to transmit the driving force to the first rotational member. The rotational-member driving gear may be rotatable about the rotational axis of the driven member.

Additional aspects of the disclosure relate to a cartridge which may include a photosensitive drum configured to rotate around an axis and a first rotational member disposed proximate a periphery of the photosensitive drum and configured to rotate about an axis parallel to the rotational axis of the photosensitive drum. The cartridge may also include a driven member, which includes a transmitted portion and a flange fitted to an end of the photosensitive drum. The driven member may be configured to rotate about the rotational axis of the photosensitive drum together with the photosensitive drum and the transmitted portion of the driven member may be configured to receive a driving force transmitted from outside. The driven member may also include a joint which includes first engaging projections formed apart from each other with respect to the rotational axis of the joint. The cartridge may also include a rotational-member driving gear which includes a loose fit portion configured to engage with the first engaging projections and a transmission gear portion configured to transmit the driving force to the first rotational member. The rotational-member driving gear may be rotatable about the rotational axis of the driven member or a rotational axis parallel to the rotational axis of the driven member. The joint may be disposed between the flange and the rotational-member driving gear. The flange may include second engaging projections formed apart from each other with respect to the rotational axis of the driven member. The joint may include two notches extending in the radial direction of the joint and configured to engage with the second engaging projections. The loose fit portion may include two loose fit portions corresponding to the first engaging projections, the loose fit portions having clearances with respect to the first engaging projections both in the rotation direction and the radial direction of the rotational-member driving gear. The driven member, the rotational-member driving gear, and the joint may form an Oldham's coupling.

DETAILED DESCRIPTION

As discussed above, aspects of the present disclosure relate to an image forming apparatus which may include a photosensitive drum configured to rotate around an axis and a first rotational member disposed proximate a periphery of the photosensitive drum and configured to rotate about an axis parallel to the rotational axis of the photosensitive drum. The image forming apparatus may also include a driving-force transmitting member and a driven member, which includes a transmitted portion and a first engaging projection. The driven member may be configured to rotate about the rotational axis of the photosensitive drum together with the photosensitive drum and the transmitted portion of the driven member may be configured to receive a driving force transmitted from the driving-force transmitting member. The image forming apparatus may also include a rotational-member driving gear which has a loose fit portion configured to engage with the first engaging projection and a transmission gear portion configured to transmit the driving force to the first rotational member. The rotational-member driving gear may be rotatable about the rotational axis of the driven member.

According to aspects of the present disclosure when a driving force is transmitted from the driving-force transmitting member to the transmitted portion of the driven member, the photosensitive drum is rotated together with the driven member. Furthermore, the driving force transmitted to the driven member is transmitted via the first engaging projection and the loose fit portion to the rotational-member driving gear. That is, when the driven member is rotated, the first engaging projection presses an inner surface of the loose fit portion toward a downstream side in the rotation direction of the driven member, and the rotational-member driving gear is rotated in the same direction as the driven member. The driving force transmitted to the rotational-member driving gear is transmitted to the first rotational member via the transmission gear portion.

Therefore, even when the rotational speed of the rotational-member driving gear varies, because the first engaging projection is loosely fitted to the loose fit portion, such variation in rotational speed can be prevented from being transmitted to the driven member. As a result, the rotational speed of the photosensitive drum can be stabilized.

Embodiments of the present disclosure will be described in detail below with reference to the attached drawings.

<First Embodiment>

1. Color Printer

Figure 1:
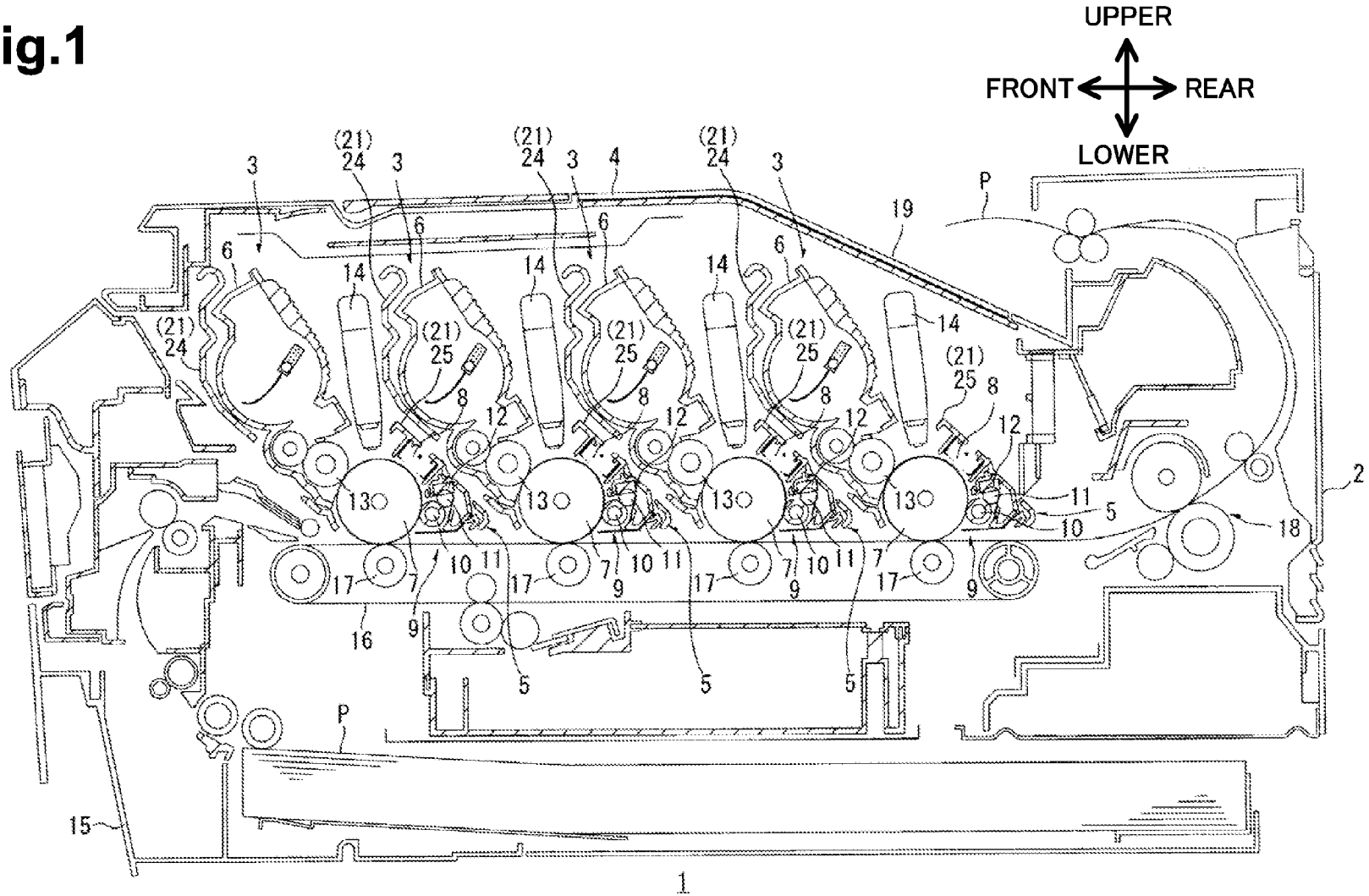
FIG. 1 is a cross-sectional view of a color printer according to an embodiment of the present disclosure.

According to aspects of the disclosure, the image forming apparatus may be a color printer, such as a tandem-type color printer. For example, FIG. 1 illustrates a color printer 1 as an example of the image forming apparatus. The color printer 1 includes a body casing 2. The body casing 2 accommodates four process cartridges 3 arranged side-by-side in a predetermined direction. The four process cartridges 3 correspond to black, yellow, magenta, and cyan, and the black, yellow, magenta, and cyan cartridges are arranged in sequence from one side in a predetermined direction. The process cartridges 3 can be attached to and detached from the inside of the body casing 2 when a top cover 4 on the top surface of the body casing 2 is open.

Note that, in the following description, top, bottom, left, and right directions are defined based on an assumption that a side where the black process cartridge 3 is disposed (the left side in FIG. 1) is the front side and the respective parts of the color printer 1 (including the process cartridges 3) are viewed from the front side. Each process cartridge 3 includes a drum cartridge 5 and a developer cartridge 6 that can be attached to and detached from the drum cartridge 5. The drum cartridge 5 includes a photosensitive drum 7, a charger 8, and a cleaner 9.

The cleaner 9 may be disposed on the rear side of the photosensitive drum 7 and on the rear lower side of the charger 8. The cleaner 9 may include a primary cleaning roller 10 in contact with the surface of the photosensitive drum 7 and configured to remove deposited matter from the surface. The cleaner may also include a secondary cleaning roller 11 in contact with the surface of the primary cleaning roller 10 and configured to remove the deposited matter having been transferred from the surface of the photosensitive drum 7 to the surface of the primary cleaning roller 10. The cleaner may also include a contact member 12 in contact with the surface of the secondary cleaning roller 11 and configured to scrape off the deposited matter having been transferred from the surface of the primary cleaning roller 10 to the surface of the secondary cleaning roller 11.

The primary cleaning roller 10 and the secondary cleaning roller 11 are provided so as to be rotatable about rotational axes extending in the left-right direction. The primary cleaning roller 10 may be in contact with the photosensitive drum 7 from the rear side. The secondary cleaning roller 11 may be in contact with the primary cleaning roller 10 from the upper rear side. The contact member 12 may be in contact with the secondary cleaning roller 11 from the upper side.

The developer cartridge 6 includes a developing roller 13. When the developer cartridge 6 is attached to the drum cartridge 5, the developing roller 13 may be in contact with the surface of the photosensitive drum 7 from the upper front side.

Furthermore, the body casing 2 accommodates LED units 14 corresponding to the photosensitive drums 7. The tip of each LED unit 14 faces the circumferential surface of the photosensitive drum 7 corresponding to the LED unit 14.

The surfaces of the photosensitive drums 7 are evenly charged by discharge from the chargers 8 and are then selectively exposed to LEDs provided in the LED units 14. By this exposure, the electric charges are selectively removed from the surfaces of the photosensitive drums 7, and electrostatic latent images are formed on the surfaces of the photosensitive drums 7. When the electrostatic latent images face the developing rollers 13, the developing rollers 13 supply toner to the electrostatic latent images. Thus, toner images are formed on the surfaces of the photosensitive drums 7.

A sheet-feed cassette 15 accommodating sheets P is disposed at the bottom of the body casing 2. A sheet P accommodated in the sheet-feed cassette 15 is conveyed onto a conveying belt 16 by various rollers. The conveying belt 16 is disposed so as to face the four photosensitive drums 7 from below. Transfer rollers 17 are disposed at positions facing the photosensitive drums 7 with the upper portion of the conveying belt 16 therebetween. The sheet P conveyed onto the conveying belt 16 passes between the conveying belt 16 and the respective photosensitive drums 7 successively as the conveying belt 16 runs. Then, the toner images on the surfaces of the photosensitive drums 7 are transferred to the sheet P when they face the sheet P.

A fixing unit 18 is provided on the downstream side of the conveying belt 16 in the conveying direction of the sheet P. The sheet P, to which the toner images have been transferred, is conveyed to the fixing unit 18. In the fixing unit 18, the toner images are fixed to the sheet P by applying heat and pressure. After the toner images are fixed, the sheet P is discharged by various rollers onto a sheet-output tray 19 on the top surface of the body casing 2.

2. Drum Cartridge (1) Frame

Figure 2:
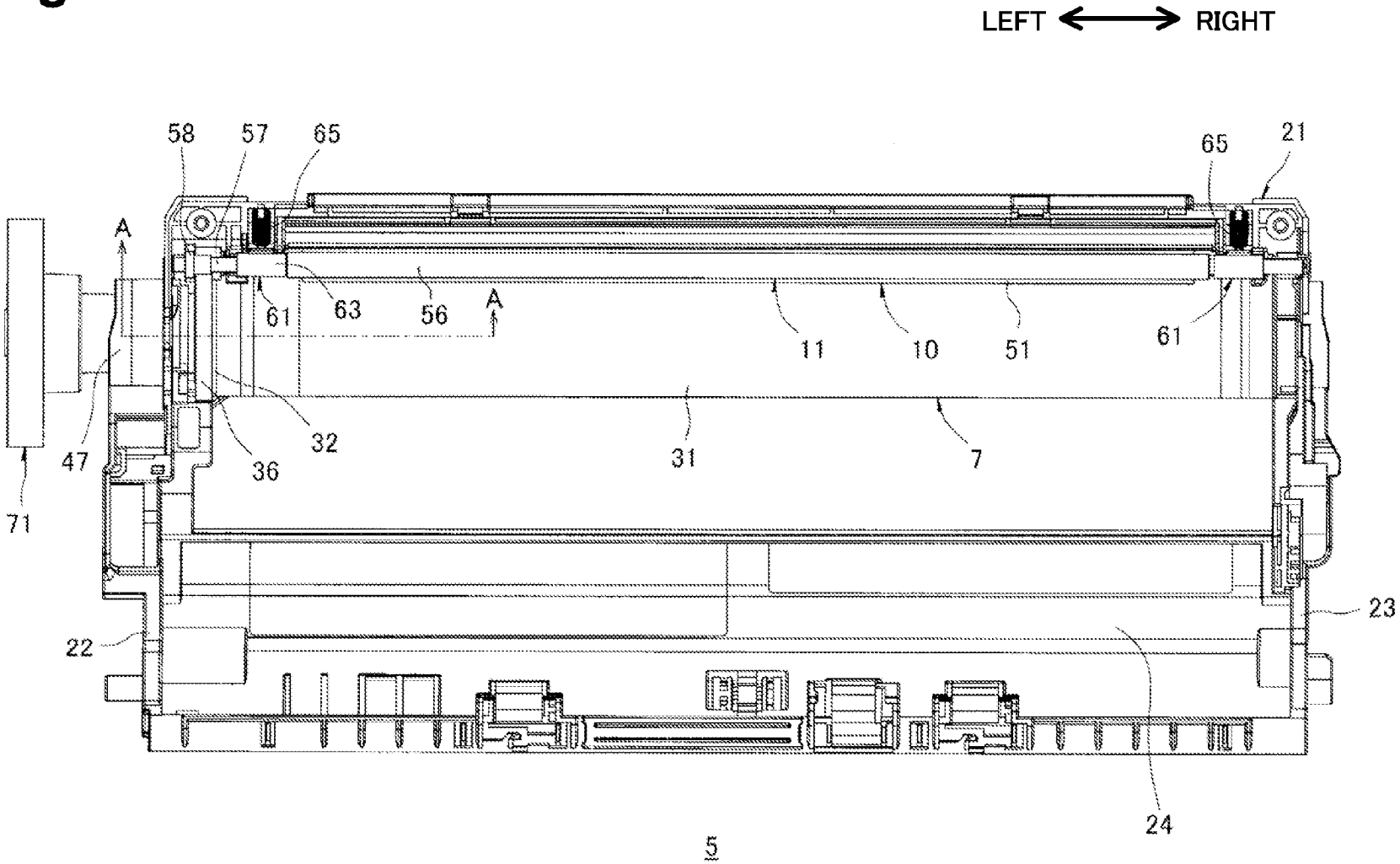
FIG. 2 is a diagram of a drum cartridge shown in FIG. 1, viewed from an upper rear side, in which a driving-force transmitting member is also shown.

As shown in FIGS. 1 and 2, each drum cartridge 5 includes a frame 21. As shown in FIG. 2, the frame 21 includes a pair of side plates 22 and 23 facing each other at a certain distance in the left-right direction. Furthermore, as shown in FIGS. 1 and 2, the frame 21 includes a bottom plate 24 provided between the front edges of the pair of side plates 22 and 23 so as to be inclined with the front side being higher. In addition, as shown in FIG. 1, the frame 21 includes a cover plate 25 provided between the rear edges of the bottom ends of the side plates 22 and 23, at a certain distance from the bottom plate 24, so as to be inclined with the front side being higher. It is noted that FIG. 2 shows the drum cartridge 5 without the cover plate 25.

The photosensitive drum 7, the charger 8, the primary cleaning roller 10 as an example of the first rotational member, the secondary cleaning roller 11 as an example of the second rotational member, and the contact member 12 are accommodated in a space between the bottom plate 24 and the cover plate 25. The photosensitive drum 7, the primary cleaning roller 10, and the secondary cleaning roller 11 are provided between the pair of side plates 22 and 23 so as to be rotatable. The charger 8 and the contact member 12 are retained by the cover plate 25. The developer cartridge 6 is attached to the bottom plate 24, at a portion not facing the cover plate 25.

(2) Photosensitive Drum

Figure 3:
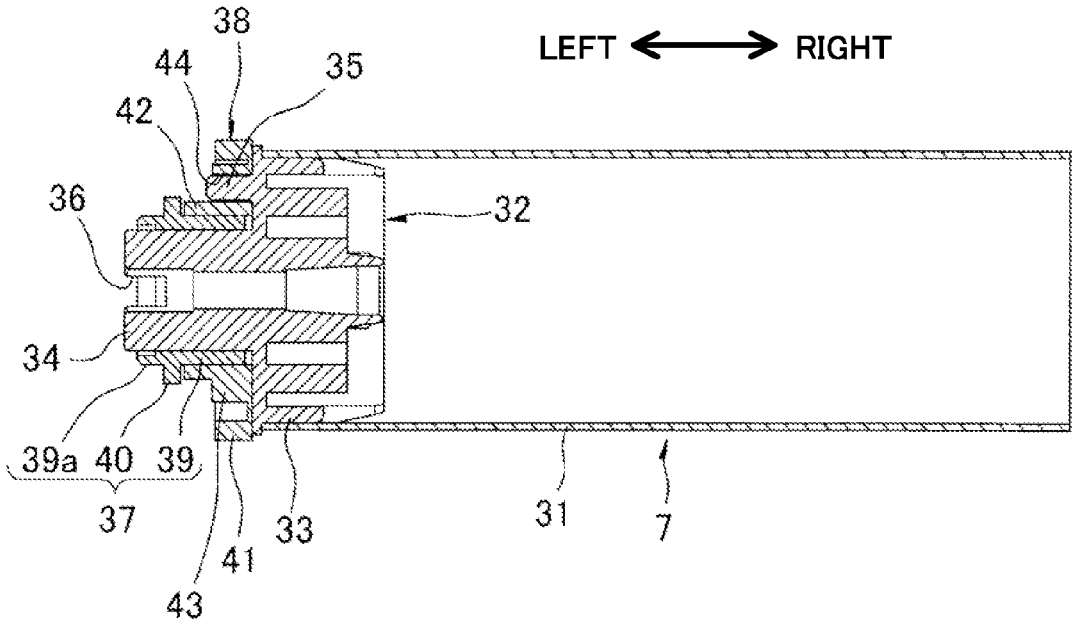
FIG. 3 is a cross-sectional view of a photosensitive drum, bearing member, and cleaning driving gear shown in FIG. 2, taken along line A-A.

As shown in FIG. 3, the photosensitive drum 7 may include a cylindrical drum body 31 and a flange 32 fixed to the left end of the drum body 31. The drum body 31 is made of a conducting material, such as aluminum. The surface of the drum body 31 is covered with a positively charged photosensitive layer composed of polycarbonate or the like.

Figure 4:
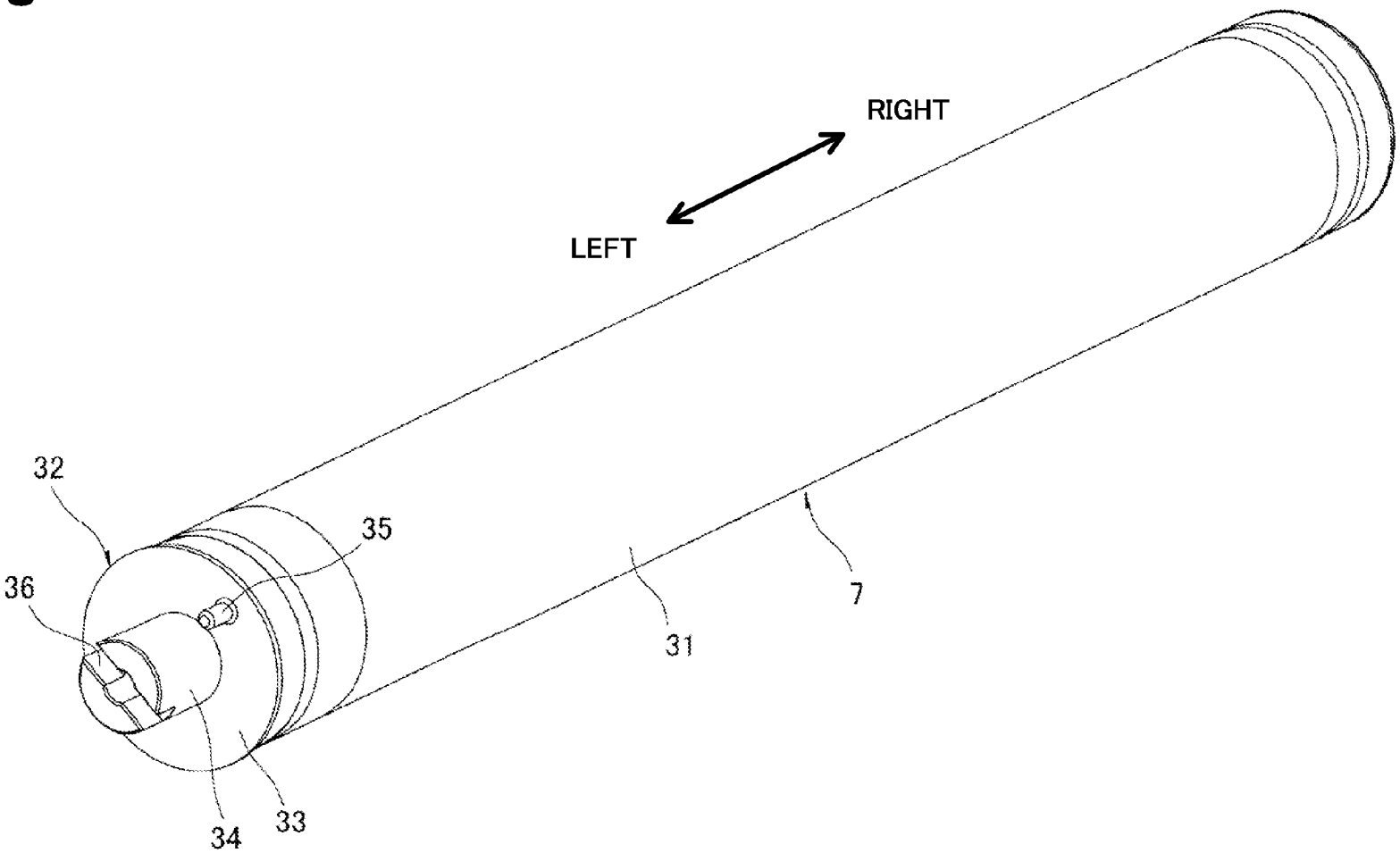
FIG. 4 is a perspective view of the photosensitive drum shown in FIG. 2.

The flange 32 may be made of resin. The flange 32 may include, as a single component, a fixed portion 33 pressed into the left end of the drum body 31 and fixed thereto, a substantially cylindrical boss portion 34 extending to the left from the central portion of the outer end surface of the fixed portion 33, and a cylindrical engaging projection 35 protruding from the outer end surface of the fixed portion 33 and provided at a certain distance from the boss portion 34. As shown in FIG. 4, the outer end surface (tip surface) of the boss portion 34 has a driven-side groove 36 extending in a straight line along the diameter thereof.

Figure 5:
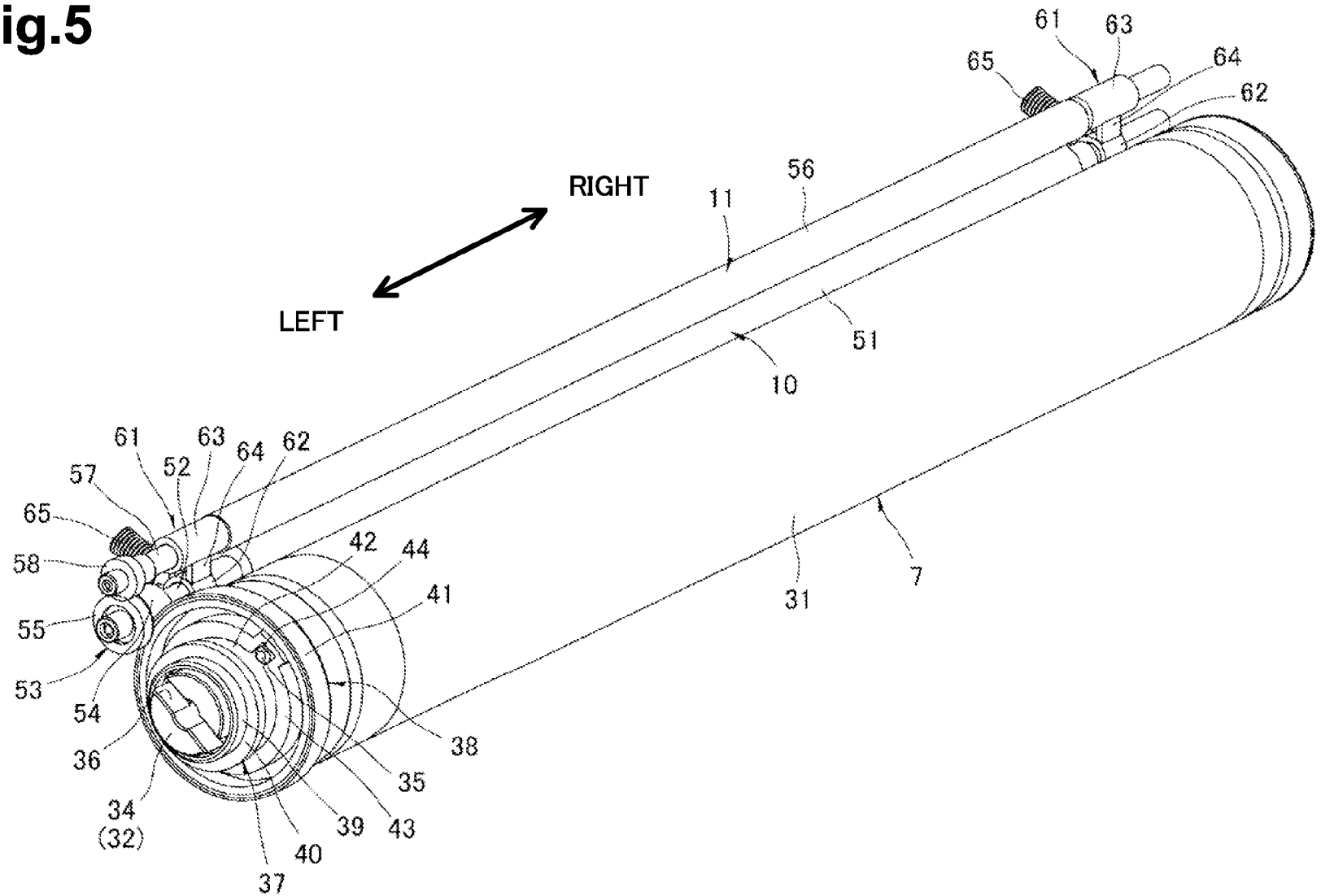
FIG. 5 is a perspective view of the photosensitive drum, first cleaning roller, second cleaning roller, and cleaning driving gear shown in FIG. 2.

As shown in FIGS. 3 and 5, a cleaning driving gear 38 as an example of the rotational-member driving gear is externally fitted to the boss portion 34 of the flange 32 via a bearing member 37 so as to be rotatable.

Figure 6:
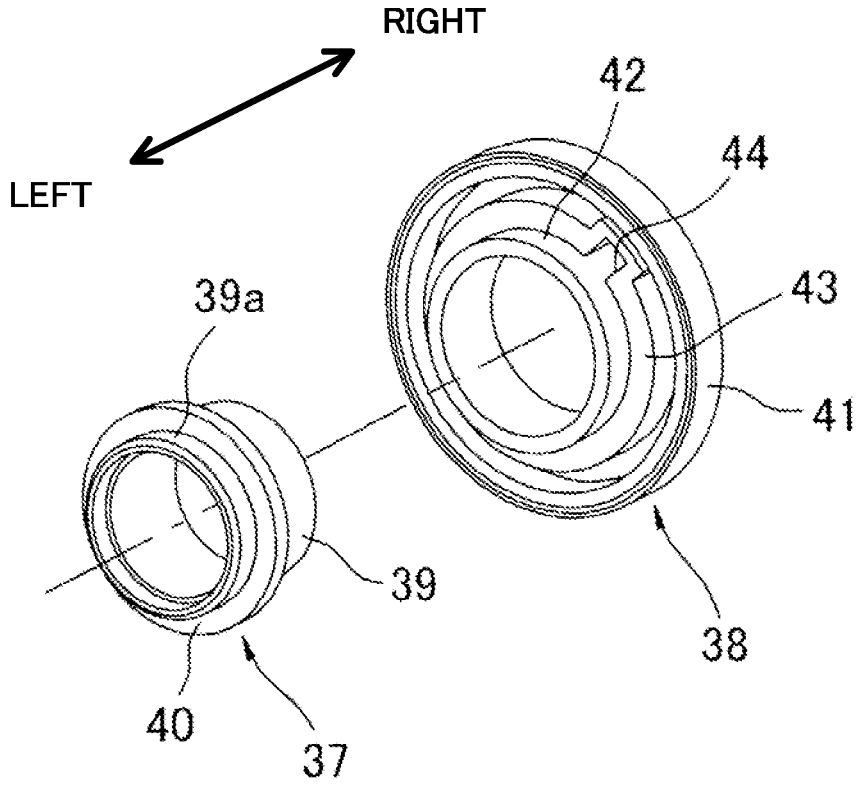
FIG. 6 is an exploded perspective view of a bearing member and cleaning driving gear shown in FIG. 5.

The bearing member 37 may be made of resin. As shown in FIG. 6, the bearing member 37 may include, as a single component, a cylindrical bearing body 39, a collar 40 extending from the left side of the outer circumferential surface of the bearing body 39 toward the periphery, and a tubular cylindrical portion 39*a* extending to the left side from the left end of the bearing body 39 and having an inside diameter slightly larger than the bearing body 39.

The cleaning driving gear 38 may be made of resin. As shown in FIGS. 5 and 6, the cleaning driving gear 38 may include, as a single component, a gear portion 41 as an example of the ring-plate-shaped transmission gear portion having gear teeth (not shown) formed on the outer circumferential surface thereof, a tubular cylindrical portion 42 extending to the left side from the circumference of a circular hole provided at the central portion of the gear portion 41, and a connecting portion 43 connected to the inner circumferential surface of the gear portion 41 and the outer circumferential surface of the cylindrical portion 42.

The outer surface of the connecting portion 43 may extend from the entire inner circumferential surface of the gear portion 41 toward the radially inside of the gear portion 41, may be bent and extend to the left side, may be bent and extend to the radially inside, and may be connected to the outer circumferential surface of the cylindrical portion 42.

Figure 7:
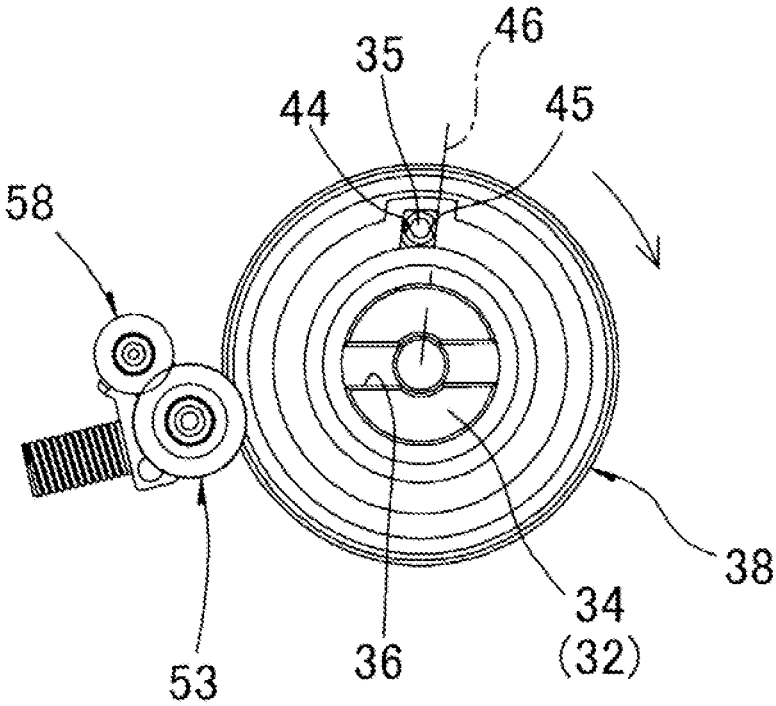
FIG. 7 is a side view of a flange, cleaning driving gear, primary cleaning gear, and secondary cleaning gear shown in FIG. 5, viewed from the left side.

The connecting portion 43 has a loose fit portion 44, which is a rectangular opening in side view, penetrating therethrough in the left-right direction. The width of the loose fit portion 44 in the rotation direction of the cleaning driving gear 38 is larger than the diameter of the engaging projection 35. Furthermore, as shown in FIG. 7, the loose fit portion 44 is formed such that a surface 45 on the downstream side in the rotation direction of the cleaning driving gear 38 is included in a plane 46 including the rotational axis of the cleaning driving gear 38 (a plane extending along or through the rotation diameter of the cleaning driving gear 38).

The side plate 22 of the frame 21 on the left side has a circular hole (not shown) having an inside diameter substantially the same as the outside diameter of the cylindrical portion 39*a* of the bearing member 37. Furthermore, as shown in FIG. 2, the side plate 22 has an integrally formed cylindrical protecting portion 47 extending to the left from the circumference of the hole.

As shown in FIG. 6, the bearing body 39 of the bearing member 37 may be internally fitted to the cylindrical portion 42 of the cleaning driving gear 38 from the left side. Furthermore, as shown in FIGS. 3 and 5, the boss portion 34 of the flange 32 may be internally fitted to the bearing body 39 of the bearing member 37 from the right side, and the engaging projection 35 as an example of the first engaging projection may be loosely fitted to the loose fit portion 44. Then, the left end of the cylindrical portion 39*a* may be fitted to the hole provided in the side plate 22, and thus, the bearing member 37 is fixed to the side plate 22 with the collar 40 of the bearing member 37 being in contact with the side plate 22 from the right side, and the right end of the drum body 31 is retained by the side plate 23 on the right side so as to be rotatable. Thus, the boss portion 34 of the flange 32 is received by the inner circumferential surface of the bearing body 39 so as to be rotatable, the cylindrical portion 42 of the cleaning driving gear 38 is received by the outer circumferential surface of the bearing body 39 so as to be rotatable, and the photosensitive drum 7 is retained between the left and right side plates 22 and 23 so as to be rotatable about the axis extending in the left-right direction. The driven-side groove 36 as an example of the transmitted portion of the flange 32 may be exposed on the left side inside the protecting portion 47.

(3) Primary Cleaning Roller

As shown in FIG. 5, the primary cleaning roller 10 includes a cylindrical roller body 51 and a roller shaft 52 that extends along the central axis of the roller body 51 and protrudes from the end surfaces of the roller body 51. The roller body 51 may be made of a sponge material. For example, the roller body 51 of the primary cleaning roller 10 is not limited to a sponge roller that is made of a sponge material, but may be a so-called brush roller in which multiple bristles are implanted on the circumferential surface of the roller body 51.

A primary cleaning gear 53 as an example of the rotational gear is attached to the left end of the roller shaft 52, at a certain distance from the roller body 51. The primary cleaning gear 53 may be a two-speed gear that includes, as a single component, an input gear portion 54 and an output gear portion 55. The input gear portion 54 is cylindrical. The circumferential surface of the input gear portion 54 has gear teeth (not shown) that are configured to mesh with the cleaning driving gear 38. For example, the gear teeth of the input gear portion 54 may be configured to mesh with the gear teeth of the cleaning driving gear 38. The output gear portion 55 may be provided to the left of the input gear portion 54 and have a flat cylindrical shape with a larger diameter (gear diameter) than the input gear portion 54. The circumferential surface of the output gear portion 55 has gear teeth (not shown). Because the roller shaft 52 extends through the openings in the input gear portion 54 and output gear portion 55 so as not to be rotatable, the primary cleaning gear 53 and the roller shaft 52 can be rotated together.

(4) Secondary Cleaning Roller

The secondary cleaning roller 11 may be made of metal and may include, as a single component, a cylindrical roller body 56 and a roller shaft portion 57 that extends along the central axis of the roller body 56 and protrudes from the end surfaces of the roller body 56, as shown in FIG. 4.

A secondary cleaning gear 58 is attached to the left end of the roller shaft portion 57, at a certain distance from the roller body 56. The secondary cleaning gear 58 may have a flat cylindrical portion having gear teeth (not shown) on the circumferential surface thereof, and the roller shaft portion 57 extends through the opening therein so as not to be rotatable. Thus, it can be rotated together with the roller shaft portion 57. The gear teeth of the secondary cleaning gear 53 are configured to mesh with the output gear portion 55 of the primary cleaning gear 53.

(5) Shaft Connecting Member

As shown in FIG. 5, the roller shaft 52 of the primary cleaning roller 10 and the roller shaft portion 57 of the secondary cleaning roller 11 are connected to each other at both ends by shaft connecting members 61. Each shaft connecting member 61 may include, as a single component, a cylindrical first insertion portion 62 through which the roller shaft 52 extends so as to be rotatable, a cylindrical second insertion portion 63 through which the roller shaft portion 57 extends so as to be rotatable, and a connecting portion 64 that connects the first insertion portion 62 and the second insertion portion 63. The shaft connecting member 61 on the left side is provided between: (1) the roller body 51 of the primary cleaning roller 10 and the roller body 56 of the secondary cleaning roller 11; and (2) the primary cleaning gear 53 and the secondary cleaning gear 58.

According to aspects of the disclosure, a coil spring as an example of the urging member may be provided. An end of a coil spring 65 may be connected to the first insertion portion 62. The other end of the coil spring 65 may be connected to the frame 21 of the drum cartridge 5, as shown in FIG. 2. Accordingly, the coil spring 65 is disposed in a compressed state between the frame 21 and the first insertion portion 62. Thus, the coil spring 65 urges the first insertion portion 62 toward the photosensitive drum 7, whereby the primary cleaning roller 10 is elastically in contact with the surface of the photosensitive drum 7.

3. Driving-Force Transmitting Member

As shown in FIG. 2, the body casing 2 (see FIG. 1) accommodates driving-force transmitting members 71 that transmit driving forces for rotating the photosensitive drums 7, the primary cleaning rollers 10, and the secondary cleaning rollers 11 to the flanges 32 and the cleaning driving gears 38.

Figure 8:
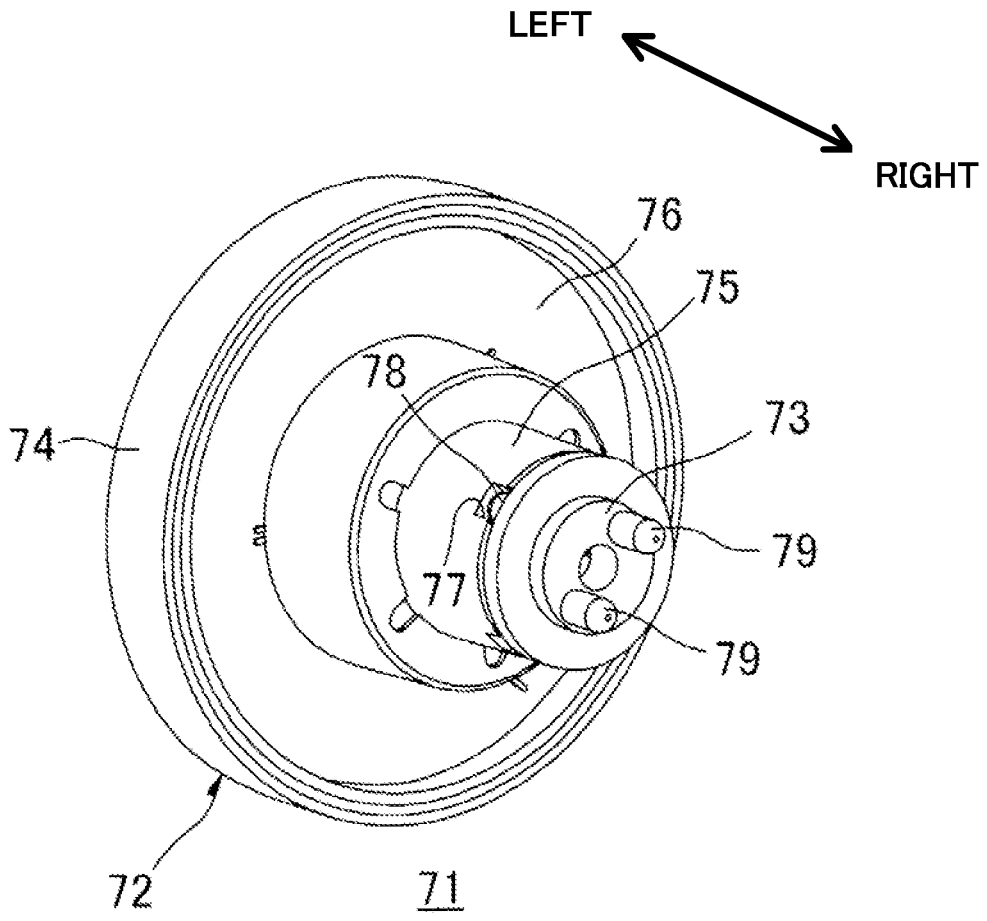
FIG. 8 is a perspective view of a driving-force transmitting member shown in FIG. 2.

As shown in FIG. 8, each driving-force transmitting member 71 may include a driving-force transmitting gear 72 and an intermediate member 73 disposed between the driving-force transmitting gear 72 and the flange 32 to connect between the driving-force transmitting gear 72 and the flange 32.

The driving-force transmitting gear 72 may include a cylindrical gear portion 74, a substantially cylindrical attaching portion 75 that is coaxial with the gear portion 74, and a connecting portion 76 that is connected to the inner circumferential surface of the gear portion 74 and the outer circumferential surface of the attaching portion 75. According to aspects of the disclosure, the gear portion 74, the attaching portion 75 and the connecting portion 76 may be a single component. The outer circumferential surface of the gear portion 74 may have gear teeth (not shown).

The right end of the attaching portion 75 protrudes to the right side from the right end surface of the gear portion 74. The right end surface of the attaching portion 75 may have a driving-side groove 77 having the shape of a cross intersecting at the center thereof.

The connecting portion 76 may extend from the entire inner circumferential surface of the gear portion 74 toward the radially inside of the gear portion 74, may be bent and extend to the right side, may be bent and extend to the radially inside, and may be connected to the central portion of the outer circumferential surface of the attaching portion 75 in the left-right direction.

The intermediate member 73 may be ring-plate-shaped. Cylindrical driving-side protrusions 78 with tip surfaces being formed in a hemispherical shape may be provided on the left end surface of the intermediate member 73 at two positions apart from each other by 180° with respect to the central axis thereof, so as to protrude to the left side. Further, cylindrical driven-side protrusions 79 with tip surfaces being formed in a hemispherical shape may be provided on the right end surface of the intermediate member 73 at two positions apart from each other by 180° with respect to the central axis thereof, the positions being shifted from the driving-side protrusions 78 by 90° with respect to the central axis of the intermediate member 73, so as to protrude to the right side.

The intermediate member 73 may be attached to the attaching portion 75 of the driving-force transmitting gear 72 such that the driving-side protrusions 78 are fitted to the driving-side groove 77 in the driving-force transmitting gear 72.

4. Attachment/Detachment of Driving-Force Transmitting Member to/from Drum Cartridge As shown in FIG. 2, the driving-force transmitting member 71 may be disposed at a position facing the protecting portion 47 for the drum cartridge 5 attached in the body casing 2 so as to be capable of advancing and retracting in the left-right direction, between an advancing position on the relatively right side and a retracting position on the relatively left side.

When the driving-force transmitting member 71 has been advanced to the advancing position, the tip (right end) of the attaching portion 75 and the intermediate member 73 of the driving-force transmitting gear 72 are in the protecting portion 47, and the driven-side protrusions 79 of the intermediate member 73 are fitted to the driven-side groove 36 of the flange 32. By this, the flange 32, the driving-force transmitting gear 72, and the intermediate member 73 form an Oldham's coupling. The driving-force transmitting gear 72 is connected to the flange 32 via the intermediate member 73.

Further, when the driving-force transmitting member 71 has been retracted to the retracting position, the intermediate member 73 is located outside the protecting portion 47, and the driven-side protrusions 79 of the intermediate member 73 are detached from the driven-side groove 36 of the flange 32.

5. Transmission of Driving Force

A body driving gear (not shown) provided in the body casing 2 meshes with the gear teeth of the driving-force transmitting gear 72. A driving force from a motor (not shown) provided in the body casing 2 is input to the body driving gear. When the driving force from the motor is input to the body driving gear, and the body driving gear is rotated, the driving force is transmitted from the body driving gear to the driving-force transmitting gear 72.

When the driving-force transmitting gear 72 is connected to the flange 32 via the intermediate member 73, the driving force transmitted to the driving-force transmitting gear 72 is transmitted from the driving-force transmitting gear 72 to the intermediate member 73, and is transmitted from the intermediate member 73 to the flange 32. By this, the photosensitive drum 7 is rotated together with the flange 32.

When the flange 32 is rotated, the engaging projection 35 of the flange 32 comes into contact with the inner surface 45 of the loose fit portion 44, and the engaging projection 35 presses the inner surface 45. By this, the cleaning driving gear 38 is rotated in the same direction as the flange 32. Then, the driving force is transmitted from the cleaning driving gear 38 to the primary cleaning gear 53, and the primary cleaning roller 10 is rotated together with the primary cleaning gear 53. In addition, the driving force is transmitted from the primary cleaning gear 53 to the secondary cleaning gear 58, and the secondary cleaning roller 11 is rotated together with the secondary cleaning gear 58.

As has been described, the primary cleaning roller 10 is disposed at the periphery of the photosensitive drum 7 so as to be rotatable about an axis parallel to the rotational axis of the photosensitive drum 7. The flange 32 is provided so as to be rotatable together with the photosensitive drum 7. The flange 32 includes the engaging projection 35 and the driven-side groove 36 to which a driving force is transmitted from the driving-force transmitting member 71. The cleaning driving gear 38 has the loose fit portion 44 to which the engaging projection 35 is loosely fitted and the gear portion 41 that transmits a driving force to the primary cleaning roller 10.

When a driving force is transmitted from the driving-force transmitting member 71 to the driven-side groove 36 of the flange 32, the photosensitive drum 7 is rotated together with the flange 32. Furthermore, the driving force transmitted to the flange 32 is transmitted via the engaging projection 35 and the loose fit portion 44 to the cleaning driving gear 38. That is, when the flange 32 is rotated, the engaging projection 35 presses the inner surface 45 of the loose fit portion 44 toward the downstream side in the rotation direction of the flange 32, and the cleaning driving gear 38 is rotated in the same direction as the flange 32. The driving force transmitted to the cleaning driving gear 38 is transmitted to the primary cleaning roller 10 via the gear portion 41.

Accordingly, even when the rotational speed of the cleaning driving gear 38 varies, because the engaging projection 35 is loosely fitted to the loose fit portion 44, such variation in rotational speed can be prevented from being transmitted to the flange 32. As a result, the rotational speed of the photosensitive drum 7 can be stabilized.

Further, it is noted that the loose fit portion 44 is longer than the width of the engaging projection 35 in the rotation direction of the cleaning driving gear 38. That is, the engaging projection 35 and the loose fit portion 44 have a clearance in the rotation direction of the cleaning driving gear 38. Therefore, the position of the cleaning driving gear 38 can be prevented from being shifted in the rotation radius direction (the direction of the gear diameter). As a result, the meshing between the cleaning driving gear 38 and the body driving gear meshing therewith can be maintained in appropriate conditions, and thus, the rotational speed of the photosensitive drum 7 can be further stabilized.

Further, it is noted that the surface 45 of the loose fit portion 44 with which the engaging projection 35 comes into contact while the flange 32 is rotated is in the plane 46 including the rotational axis of the cleaning driving gear 38. Therefore, the pressing force applied from the engaging projection 35 to the inner surface 45 of the loose fit portion 44 is perpendicular to the diameter of the cleaning driving gear 38. As a result, the cleaning driving gear 38 can be stably rotated.

Further, it is noted that the bearing member 37 is disposed between the flange 32 and the cleaning driving gear 38. Therefore, the flange 32 can be prevented from coming into contact with the cleaning driving gear 38. As a result, the rotation of the flange 32 can be stabilized, and hence, the rotation of the photosensitive drum 7 can be further stabilized.

Further, it is noted that the primary cleaning roller 10 is urged by the coil spring 65 toward the photosensitive drum. Therefore, the primary cleaning roller 10 can be pressed against the photosensitive drum 7 at an appropriate contact pressure. As a result, a deposited matter can be appropriately removed from the circumferential surface of the photosensitive drum 7 with the primary cleaning roller 10.

<Second Embodiment>

1. Configuration

Figure 9:
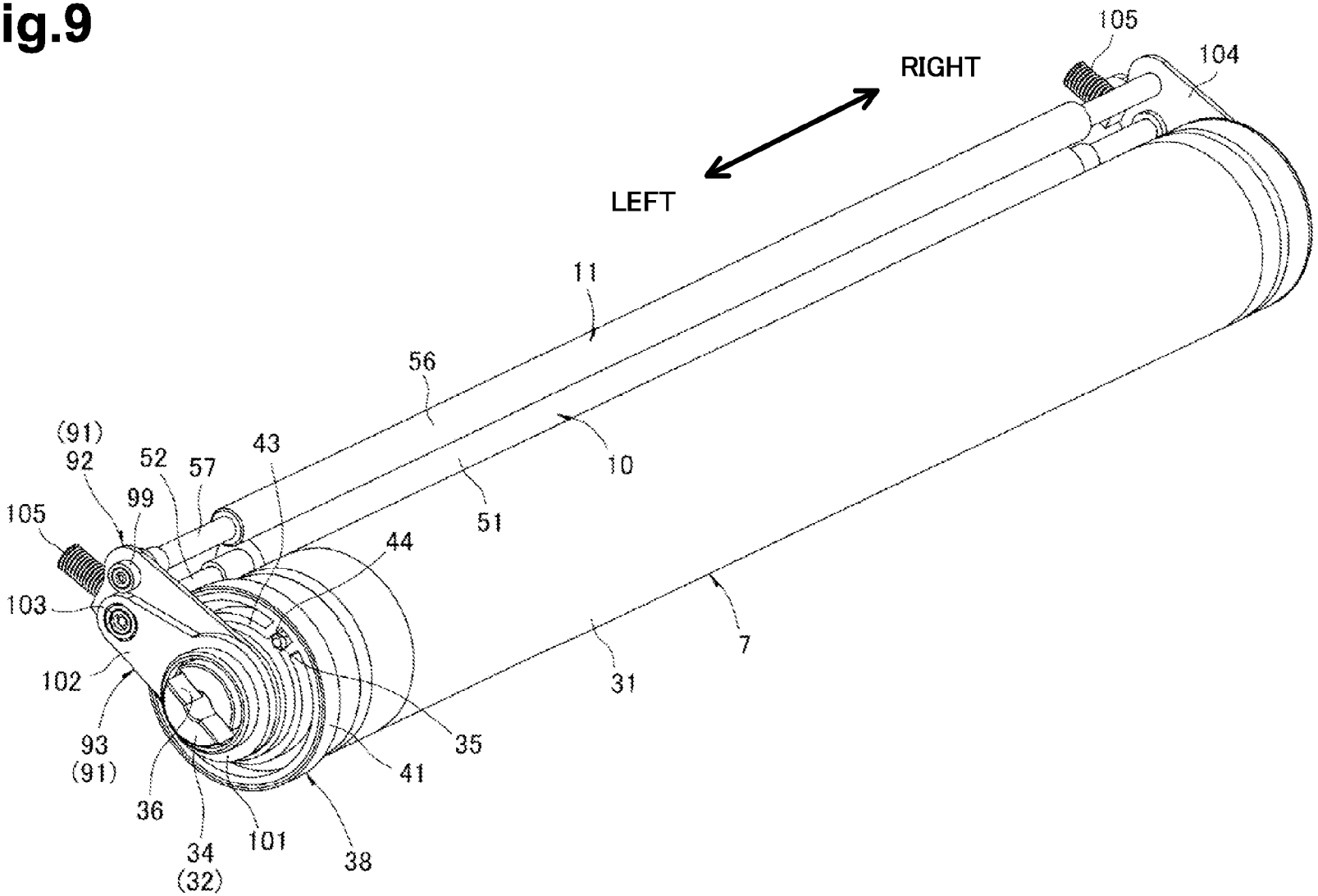
FIG. 9 is a perspective view of a photosensitive drum, first cleaning roller, second cleaning roller, cleaning driving gear, and bearing member according to another embodiment of the present disclosure.
Figure 10:
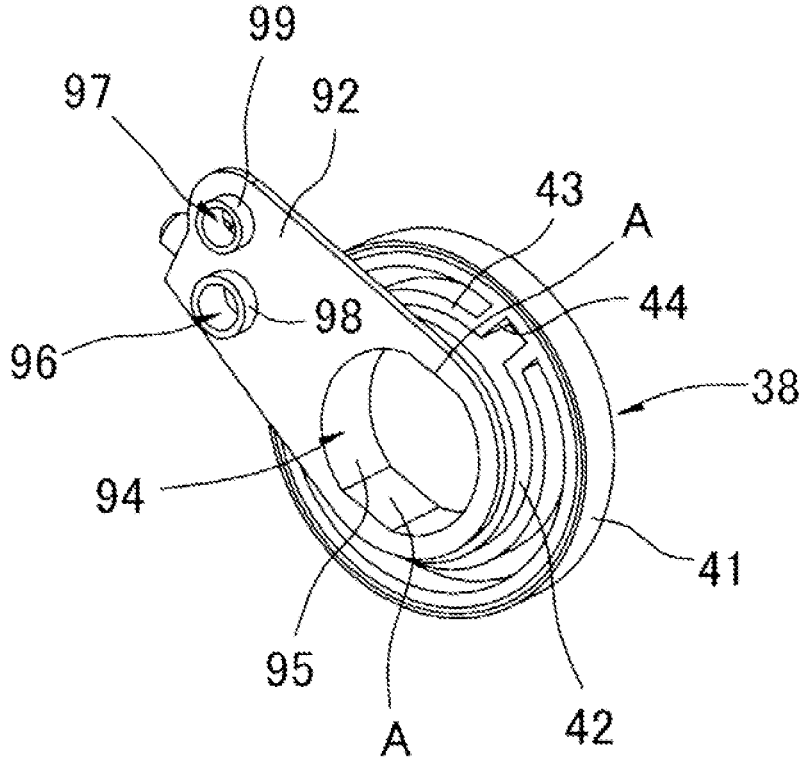
FIG. 10 is a perspective view of a first retaining member and cleaning driving gear shown in FIG. 9.
Figure 11:
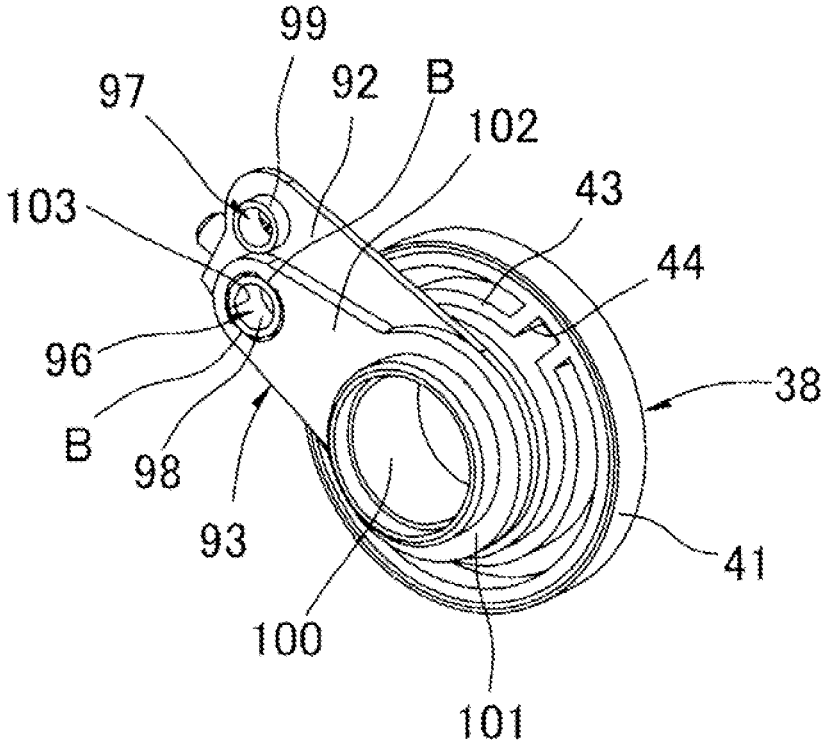
FIG. 11 is a perspective view of a cleaning driving gear and bearing member shown in FIG. 9.

Instead of the configuration shown in FIG. 5, the configuration shown in FIG. 9 may be employed. In FIGS. 9 to 11, components the same as those in the above description are denoted by the same reference numerals. In the configuration shown in FIG. 9, instead of the bearing member 37 shown in FIG. 5, a bearing member 91 is employed. The bearing member 91 includes a first retaining member 92 and a second retaining member 93.

The first retaining member 92 may be made of resin. As shown in FIG. 10, the first retaining member 92 has a substantially rectangular-plate-shape. An elongated hole 94 that is elongated in a direction in which the photosensitive drum 7 and the primary cleaning roller 10 face each other (hereinafter simply, "facing direction") may be provided at an end of the first retaining member 92 in the longitudinal direction. The elongated hole 94 has such a shape that ends of a semicircular portion protruding to one side in the facing direction are connected to ends of a semicircular portion protruding to the other side in the facing direction with straight lines A extending in the facing direction. The curvature of the semicircular portions of the elongated hole 94 is equal to or larger than the curvature of the outer circumferential surface of a cylindrical portion 100 (described below) of the second retaining member 93. The first retaining member 92 may have an integrally formed gear retaining portion 95 protruding from the circumference of the elongated hole 94 to the right side.

Furthermore, a first insertion hole 96 in which the roller shaft 52 of the primary cleaning roller 10 is inserted so as to be rotatable and a second insertion hole 97 in which the roller shaft portion 57 of the secondary cleaning roller 11 is inserted so as to be rotatable may be provided at the other end of the first retaining member 92 in the longitudinal direction. The first insertion hole 96 and the second insertion hole 97 are round holes having diameters substantially equal to the outside diameters of the roller shafts 52 and 57, respectively. The first retaining member 92 may be formed integrally with boss portions 98 and 99 that protrude to the left side from the circumferences of the first insertion hole 96 and second insertion hole 97.

As shown in FIG. 11, the second retaining member 93 may include, as a single component, a tubular cylindrical portion 100, a collar 101 extending from the left side of the outer circumferential surface of the cylindrical portion 100 toward the periphery, and an extension portion 102 extending from the collar 101 in the facing direction.

A boss insertion portion 103 as an example of the insertion hole, which is an elongated hole elongated in a facing direction, is provided at the tip of the extension portion 102. The boss insertion portion 103 has such a shape that ends of a semicircular portion protruding to one side in the facing direction are connected to ends of a semicircular portion protruding to the other side in the facing direction with straight lines B extending in the facing direction. The straight lines B are substantially parallel to the straight lines A of the elongated hole 94. The curvature of the semicircular portions of the boss insertion portion 103 is equal to or larger than the curvature of the outer circumferential surface of the boss portion 98 of the first retaining member 92.

The cylindrical portion 100 of the second retaining member 93 may be internally fitted to the elongated hole 94 in the first retaining member 92 from the left side, and the boss portion 98 of the first retaining member 92 may be internally fitted to the boss insertion portion 103 of the second retaining member 93 from the right side. Thus, the first retaining member 92 and the second retaining member 93 are connected so as not to make relative rotation. Then, the cylindrical portion 42 of the cleaning driving gear 38 may be externally fitted to the gear retaining portion 95 of the first retaining member 92 from the right side, and the boss portion 34 of the flange 32 may be internally fitted to the cylindrical portion 100 of the second retaining member 93 from the right side. By this, the boss portion 34 of the flange 32 is received by the inner circumferential surface of the cylindrical portion 100 so as to be rotatable, and the cylindrical portion 42 of the cleaning driving gear 38 is received by the outer circumferential surface of the gear retaining portion 95 so as to be rotatable.

Furthermore, as shown in FIG. 9, the left end of the roller shaft 52 as an example of the rotation shaft of the primary cleaning roller 10 and the left end of the roller shaft portion 57 as an example of the rotation shaft of the secondary cleaning roller 11 may extend through the first insertion hole 96 and the second insertion hole 97 so as to be rotatable, respectively. Further, the right ends of the roller shafts 52 and 57 may extend through the bearing plate 104 so as to be rotatable. The first retaining member 92 and the bearing plate 104 are urged by coil springs 105 as an example of the urging member toward the photosensitive drum 7.

It is noted that the configuration shown in FIG. 9 achieves the benefits described above with regard to the configuration shown in FIG. 5.

Further, the bearing member 91 includes the first retaining member 92 and the second retaining member 93. The first retaining member 92 retains the roller shaft 52 of the primary cleaning roller 10 and the cleaning driving gear 38 so as to be rotatable. The second retaining member 93 retains the flange 32 so as to be rotatable. The first retaining member 92 has the elongated hole 94 that allows the first retaining member 92 and the second retaining member 93 to slide relative to each other in the facing direction.

Therefore, the distance between the photosensitive drum 7 and the primary cleaning roller 10 can be changed while maintaining a constant distance between the center of rotation of the cleaning driving gear 38 and the center of rotation of the primary cleaning gear 53 (primary cleaning roller 10). As a result, even if the primary cleaning roller 10 is deformed with the use of the color printer 1, an appropriate contact state between the photosensitive drum 7 and the primary cleaning roller 10 can be maintained.

Further, the second retaining member 93 has the boss insertion portion 103 into which the roller shaft 52 of the primary cleaning roller 10 is inserted. By this, the first retaining member 92 can be fixed in the rotation direction of the cleaning driving gear 38.

Further, the secondary cleaning roller 11 is disposed in the periphery of the primary cleaning roller 10 so as to be rotatable about an axis parallel to the rotational axis of the primary cleaning roller 10. The roller shaft portion 57 of the secondary cleaning roller 11 is retained by the first retaining member 92 so as to be rotatable. By this, constant distances between the center of rotation of the primary cleaning roller 10, the center of rotation of the secondary cleaning roller 11, and the center of rotation of the cleaning driving gear 38 can be maintained.

<Third Embodiment>

1. Configuration

Figure 12:
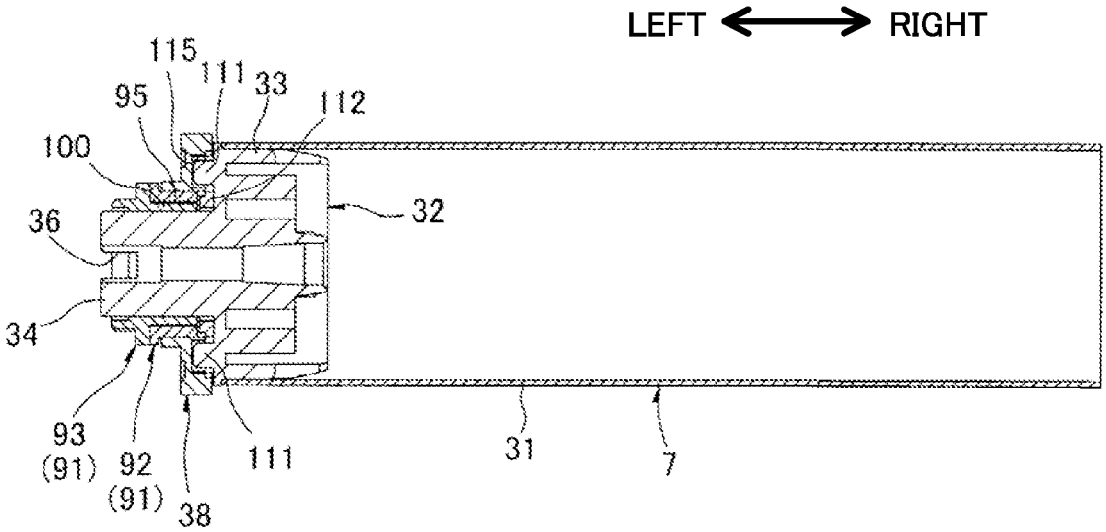
FIG. 12 is a cross-sectional view of a photosensitive drum, bearing member, cleaning driving gear, and joint according to another embodiment of the present disclosure.

Instead of the configuration shown in FIG. 3, the configuration shown in FIG. 12 may be employed. In FIGS. 12 to 15, components the same as those in the above description are denoted by the same reference numerals.

Figure 13:
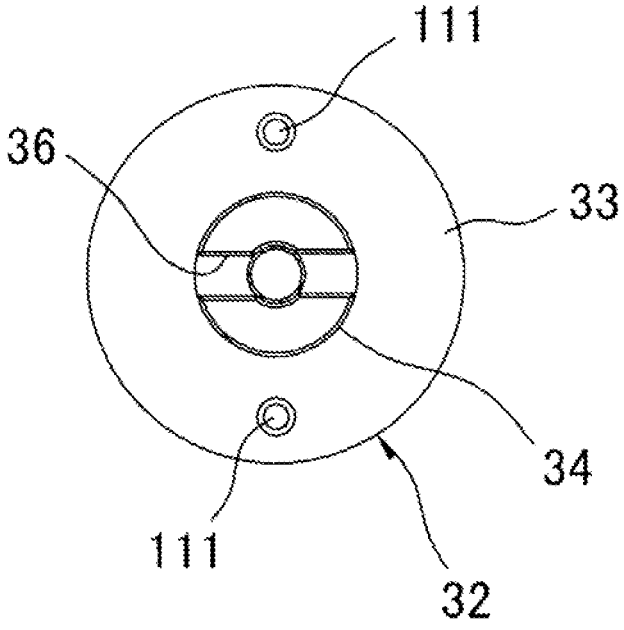
FIG. 13 is a side view of the photosensitive drum shown in FIG. 12, viewed from the left side.

In the configuration shown in FIG. 12, similarly to the configuration shown in FIG. 9, the bearing member 91 having the first retaining member 92 and the second retaining member 93 is employed. Furthermore, the flange 32 as an example of the driven member (or at least a part of the driven member) does not have the engaging projection 35 as shown in FIG. 3, but has, as shown in FIG. 13, cylindrical engaging projections 111 as an example of the second engaging projections provided at two positions apart from each other by 180° with respect to the rotational axis of the flange 32.

Figure 14:
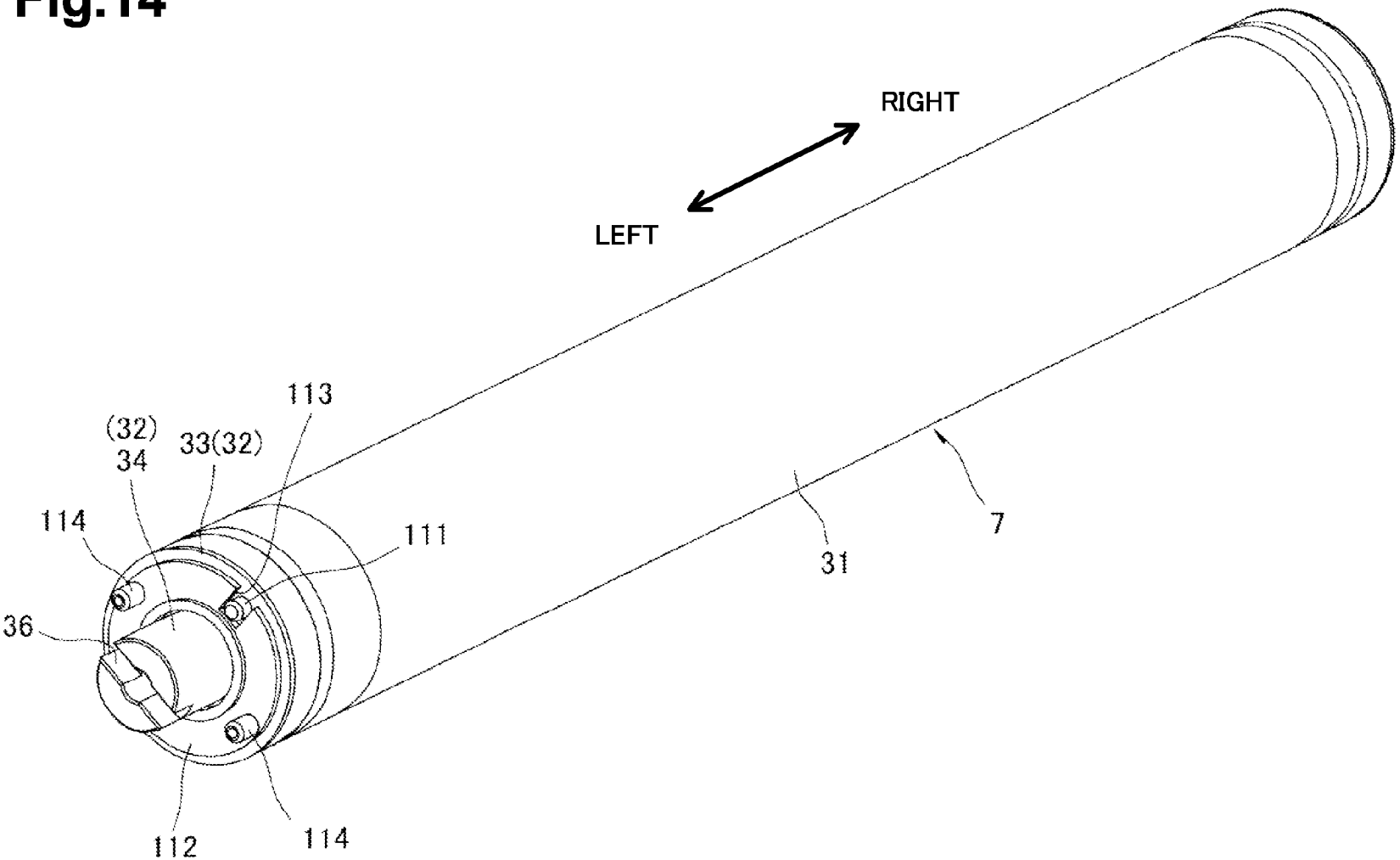
FIG. 14 is a perspective view of the photosensitive drum and joint shown in FIG. 12.

Then, as shown in FIGS. 12 and 14, thin ring-plate-shaped joint 112 is externally fitted to the boss portion 34 of the flange 32 so as to be rotatable. The joint 112 as an example of the driven member (or at least a part of the driven member) has two notches 113 corresponding to the engaging projections 111, formed by cutting rectangular portions off from the circumference thereof in the rotation radius direction of the joint 112.

Furthermore, cylindrical engaging projections 114 that are loosely fitted to the loose fit portions 44 of the cleaning driving gear 38 are provided on the left end surface of the joint 112 so as to protrude therefrom, at two positions shifted from two notches 113 by 90° with respect to the central axis of the joint 112. Therefore, the two loose fit portions 44 are provided in the connecting portion 43 of the cleaning driving gear 38. Furthermore, the loose fit portions 44 are formed such that the widths thereof in the rotation direction and in the rotation radius direction of the cleaning driving gear 38 are larger than the width (outside diameter) of the engaging projection 114.

Figure 15:
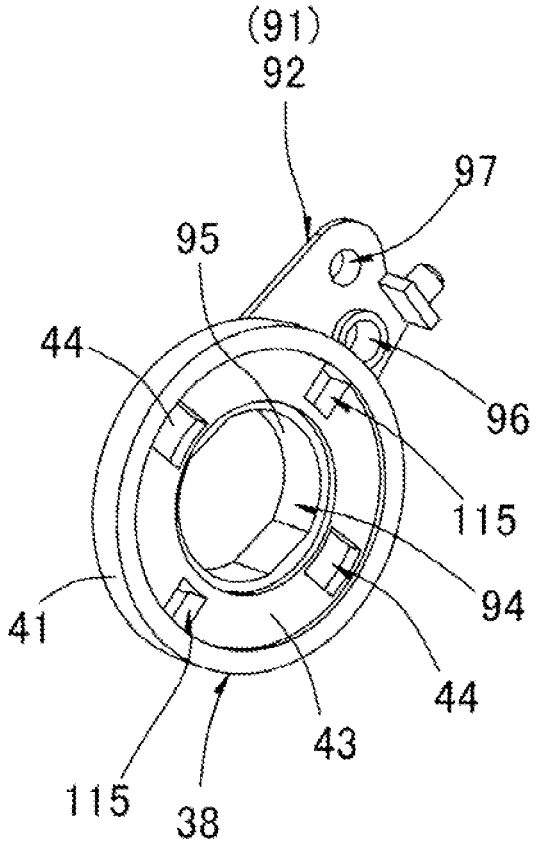
FIG. 15 is a perspective view of the cleaning driving gear and first retaining member shown in FIG. 12.

Furthermore, as shown in FIG. 15, escape holes 115 corresponding to the engaging projections 111, through which the tips of the engaging projections 111 extend, are provided in the connecting portion 43 of the cleaning driving gear 38. Furthermore, the joint 112 has, at the central portion thereof, a hole into which the boss portion 34 of the flange 32 is inserted. This hole has a diameter larger than the outside diameter of the boss portion 34.

As shown in FIG. 14, when the joint 112 is externally fitted to the boss portion 34 of the flange 32, the engaging projections 111 are engaged (fitted) with the notches 113. The cylindrical portion 42 of the cleaning driving gear 38 is externally fitted to the gear retaining portion 95 of the first retaining member 92 from the right side, the boss portion 34 of the flange 32 is internally fitted to the cylindrical portion 100 of the second retaining member 93 from the right side, and the engaging projections 114 are loosely fitted to the loose fit portions 44 of the cleaning driving gear 38. In this state, the tips of the engaging projections 111 enter the escape holes 115, leaving a gap between the tips and the cleaning driving gear 38. It is noted that this configuration achieves the benefits described above with regard to the configuration shown in FIG. 9.

Further, it is noted that the joint 112 is disposed between the flange 32 and the cleaning driving gear 38. The flange 32 has the engaging projections 111 formed at two positions apart from each other by 180° with respect to the rotational axis of the flange 32. Corresponding to them, the joint 112 has two notches 113 that are engaged with the two engaging projections 111. The notches 113 extend in the rotation radius direction of the joint 112. Furthermore, the joint 112 has the two engaging projections 114 formed at two positions apart from each other by 180° with respect to the rotational axis of the joint 112. The two loose fit portions 44 are provided corresponding to the engaging projections 114 and have clearances with respect to the engaging projections 114 in the rotation radius direction of the cleaning driving gear 38. By this, the flange 32, the cleaning driving gear 38, and the joint 112 form an Oldham's coupling. Therefore, even if there is an eccentricity error between the flange 32 and the cleaning driving gear 38, the flange 32 and the cleaning driving gear 38 can be stably rotated. The above described structure may allow the cleaning driving gear 38 to be rotatable about the rotational axis of the driven member or a rotational axis parallel to the rotational axis of the driven member.

Further, the cleaning driving gear 38 has the escape holes 115 to avoid contact with the tips of the engaging projections 111. Therefore, the engaging projections 111 do not come into contact with the cleaning driving gear 38. Thus, the cleaning driving gear 38 and the joint 112 can be attached to each other appropriately.

Conclusion

Aspects of the present disclosure are described above and in the accompanying drawings with reference to a variety of example structures, features, elements, and combinations of structures, features, and elements. The purpose served by the disclosure, however, is to provide examples of the various features and concepts related to the invention, not to limit the scope of the invention. One skilled in the relevant art will recognize that numerous variations and modifications may be made to the embodiments described above without departing from the scope of the present disclosure, as defined by the appended claims. For example, the various features and concepts described above in conjunction with FIGS. 1 through 15 may be used individually and/or in any combination or subcombination without departing from this disclosure.

REFERENCE SIGNS LIST

1: color printer
10: primary cleaning roller
11: secondary cleaning roller
32: flange
35: engaging projection
36: driven-side groove
37: bearing member
38: cleaning driving gear
41: gear portion
44: loose fit portion
45: surface
46: plane
53: primary cleaning gear
52: roller shaft
56: roller body
65: coil spring
71: driving-force transmitting member
91: bearing member
92: first retaining member
93: second retaining member
94: elongated hole
103: boss insertion portion
105: coil spring
111: engaging projection
112: joint

113: notch
114: engaging projection
115: escape hole

The invention claimed is:

1. An image forming apparatus comprising:
a photosensitive drum configured to rotate around an axis;
a first rotational member disposed proximate a periphery of the photosensitive drum and configured to rotate about an axis parallel to the rotational axis of the photosensitive drum;
a driving-force transmitting member;
a driven member, including:
a transmitted portion; and
a first engaging projection,
wherein the driven member is configured to rotate about the rotational axis of the photosensitive drum together with the photosensitive drum,
wherein the transmitted portion of the driven member is configured to receive a driving force transmitted from the driving-force transmitting member; and
a rotational-member driving gear, including:
a loose fit portion configured to engage with the first engaging projection; and
a transmission gear portion configured to transmit the driving force to the first rotational member,
wherein the rotational-member driving gear is rotatable about the rotational axis of the driven member.

2. The image forming apparatus according to claim 1, wherein the loose fit portion has a width larger than a width of the first engaging projection in the rotation direction of the rotational-member driving gear.

3. The image forming apparatus according to claim 1, wherein a surface in the loose fit portion with which the first engaging projection comes into contact during the rotation of the driven member is in a plane including the rotational axis of the rotational-member driving gear.

4. The image forming apparatus according to claim 1, further comprising: a bearing member that is disposed between the driven member and the rotational-member driving gear,
wherein the bearing member is configured to receive the driven member at an inner circumferential surface so as to be rotatable, and receive the rotational-member driving gear at an outer circumferential surface so as to be rotatable.

5. The image forming apparatus according to claim 4, further comprising: a rotational gear rotatable together with the first rotational member and to which the driving force from the transmission gear portion of the rotational-member driving gear is transmitted,
wherein the bearing member includes:
a first retaining member that retains a rotation shaft of the first rotational member and the rotational-member driving gear so as to be rotatable; and
a second retaining member that retains the driven member so as to be rotatable,
wherein at least one of the first retaining member and the second retaining member have an elongated hole that allows the first retaining member and the second retaining member to slide relative to each other in a direction in which the photosensitive drum and the first rotational member are facing.

6. The image forming apparatus according to claim 5, wherein the second retaining member has an insertion hole through which the rotation shaft of the first rotational member extends.

7. The image forming apparatus according to claim 5, further comprising:
a second rotational member that is disposed proximate the periphery of the first rotational member and that is rotatable about an axis parallel to the rotational axis of the first rotational member,
wherein the first retaining member retains a rotation shaft of the second rotational member so as to be rotatable.

8. The image forming apparatus according to claim 1, wherein the driven member includes a flange fitted to an end of the photosensitive drum.

9. The image forming apparatus according to claim 1, further comprising an urging member that urges the first rotational member toward the photosensitive drum.

10. The image forming apparatus according to claim 1, wherein the first rotational member is a cleaning roller configured to remove a deposited matter from a circumferential surface of the photosensitive drum.

11. An image forming apparatus comprising:
a photosensitive drum configured to rotate around an axis;
a first rotational member disposed proximate a periphery of the photosensitive drum and configured to rotate about an axis parallel to the rotational axis of the photosensitive drum;
a driving-force transmitting member;
a driven member, including:
a transmitted portion; and
a flange fitted to an end of the photosensitive drum,
wherein the driven member is configured to rotate about the rotational axis of the photosensitive drum together with the photosensitive drum,
wherein the transmitted portion of the driven member is configured to receive a driving force transmitted from the driving-force transmitting member;
a joint which includes first engaging projections formed apart from each other with respect to the rotational axis of the joint; and
a rotational-member driving gear, including:
a loose fit portion configured to engage with the first engaging projections; and
a transmission gear portion configured to transmit the driving force to the first rotational member,
wherein the rotational-member driving gear is rotatable about the rotational axis of the driven member or a rotational axis parallel to the rotational axis of the driven member,
wherein the joint is disposed between the flange and the rotational-member driving gear,
wherein the flange includes second engaging projections formed apart from each other with respect to the rotational axis of the driven member,
wherein the joint includes two notches extending in the radial direction of the joint and configured to engage with the second engaging projections,
wherein the loose fit portion includes two loose fit portions corresponding to the first engaging projections, the loose fit portions having clearances with respect to the first engaging projections both in the rotation direction and the radial direction of the rotational-member driving gear, and
wherein the driven member, the rotational-member driving gear, and the joint form an Oldham's coupling.

12. The image forming apparatus according to claim 11, wherein the rotational-member driving gear has escape holes configured to prevent contact with the tips of the second engaging projections.

13. The image forming apparatus according to claim 11, wherein the first engaging projections are shifted from the notches by 90° with respect to the axis of the joint.

14. A cartridge comprising:

a photosensitive drum configured to rotate around an axis;

a first rotational member disposed proximate a periphery of the photosensitive drum and configured to rotate about an axis parallel to the rotational axis of the photosensitive drum;

a driven member, including:

a transmitted portion; and a first engaging projection, wherein the driven member is configured to rotate about the rotational axis of the photosensitive drum together with the photosensitive drum, wherein the transmitted portion of the driven member is configured to receive a driving force transmitted from a driving-force transmitting member; and a rotational-member driving gear, including:

a loose fit portion configured to engage with the first engaging projection; and a transmission gear portion configured to transmit the driving force to the first rotational member, wherein the rotational-member driving gear is rotatable about the rotational axis of the driven member.

15. A cartridge comprising:

a photosensitive drum configured to rotate around an axis;

a first rotational member disposed proximate a periphery of the photosensitive drum and configured to rotate about an axis parallel to the rotational axis of the photosensitive drum;

a driven member, including:

a transmitted portion; and a flange fitted to an end of the photosensitive drum, wherein the driven member is configured to rotate about the rotational axis of the photosensitive drum together with the photosensitive drum, wherein the transmitted portion of the driven member is configured to receive a driving force transmitted from a driving-force transmitting member; and a joint which includes first engaging projections formed apart from each other with respect to the rotational axis of the joint; and a rotational-member driving gear, including:

a loose fit portion configured to engage with the first engaging projections; and a transmission gear portion configured to transmit the driving force to the first rotational member, herein the rotational-member driving gear is rotatable about the rotational axis of the driven member or a rotational axis parallel to the rotational axis of the driven member, wherein the joint is disposed between the flange and the rotational-member driving gear, wherein the flange includes second engaging projections formed apart from each other with respect to the rotational axis of the driven member, wherein the joint includes two notches extending in the radial direction of the joint and configured to engage with the second engaging projections, wherein the loose fit portion includes two loose fit portions corresponding to the first engaging projections, the loose fit portions having clearances with respect to the first engaging projections both in the rotation direction and the radial direction of the rotational-member driving gear, and wherein the driven member, the rotational-member driving gear, and the joint form an Oldham's coupling.

* * * * *